US008464883B2

(12) United States Patent
Seelhofer

(10) Patent No.: US 8,464,883 B2
(45) Date of Patent: Jun. 18, 2013

(54) CLOSURE FOR THE METERED ADDITION OF A SEPARATE LIQUID SUBSTANCE

(76) Inventor: Fritz Seelhofer, Lindau (CH)

( * ) Notice: Subject to any disclaimer, the term of this patent is extended or adjusted under 35 U.S.C. 154(b) by 378 days.

(21) Appl. No.: 12/808,474

(22) PCT Filed: Jan. 9, 2009

(86) PCT No.: PCT/CH2009/000010
§ 371 (c)(1),
(2), (4) Date: Jun. 16, 2010

(87) PCT Pub. No.: WO2009/086652
PCT Pub. Date: Jul. 16, 2009

(65) Prior Publication Data

US 2010/0288766 A1 Nov. 18, 2010

(30) Foreign Application Priority Data

Jan. 12, 2008 (CH) ..... 0043/08

(51) Int. Cl.
*B65D 41/00* (2006.01)

(52) U.S. Cl.
USPC ..... 215/227; 215/DIG. 8; 206/219; 220/212

(58) Field of Classification Search
USPC ..... 220/212, 288; 215/227, DIG. 8; 206/219, 206/222, 220, 221; 222/81
See application file for complete search history.

(56) References Cited

U.S. PATENT DOCUMENTS

| | | | | |
|---|---|---|---|---|
| 6,843,368 | B1 * | 1/2005 | Frutin | 206/219 |
| 7,588,142 | B1 * | 9/2009 | Bush | 206/221 |
| 2001/0001196 | A1 | 5/2001 | Hawthorne | |

FOREIGN PATENT DOCUMENTS

| | | | |
|---|---|---|---|
| WO | WO 93/15973 | A | 8/1993 |
| WO | WO 00/78632 | A | 12/2000 |
| WO | WO 2007/129116 | A | 11/2007 |

* cited by examiner

*Primary Examiner* — Anthony Stashick
*Assistant Examiner* — Jeffrey Allen
(74) *Attorney, Agent, or Firm* — CUSPA Technology Law Associates; Yi Li

(57) ABSTRACT

A closure device for addition of a liquid substance separately packaged therein into an associated container containing a gas release liquid includes a connector sleeve and a twist cap fitting thereon. The connector sleeve holds a cup inside with the cup bottom extending into the container connector. The cup includes therein a substance container containing the liquid substance, disposed above a piercing and cutting mechanism having upwardly directed cutting tips and a downward arbor, and the cup has an opening at the bottom closed by the arbor. When the twist cap is rotated in the loosening direction, the piercing and cutting mechanism is moved upward, causing piercing of the substance container, and exposing the opening thereby pressure compensation occurs between the cup and container. Further loosening of twist cap causes pressure drop in the container, and the liquid substance is injected through the opening of the cup into the container.

16 Claims, 8 Drawing Sheets

CLOSURE FOR THE METERED ADDITION OF A SEPARATE LIQUID SUBSTANCE

This invention relates to a closure device for the metered addition of a liquid substance packaged separately in this closure device into a container equipped therewith. Various closure devices of this type have been made known. They can be screwed onto the external thread of a bottle connector or container connector in the manner of a conventional threaded cap. When loosened for the first time, a capsule disposed inside the closure device is opened, thereby releasing its contents into the bottle. The closure device is then unscrewed completely and removed from the connector, and the bottle is ready to be poured.

The conventional solutions are complex to manufacture. They are composed of a plurality of complicated injection-molded articles. The object of this invention is to create a closure device of this type that is composed of a minimal number of two to four pieces, and that can be filled aseptically, if necessary, with a separate fluid, and that permits the metered addition of the separate substance into the container after the initial opening in a visually and acoustically spectacular manner by injecting the substance into the container fluid.

This object is solved by a closure device for the metered addition of a liquid substance packaged separately in this closure device into a container equipped therewith and containing a gas releasing liquid, the closure device comprising a connector sleeve and a twist cap fitting thereon from above in an air-tight manner, wherein the liquid substance is enclosed between the connector sleeve and the twist cap, and that is characterized in that the connector sleeve holds a cup via an inner overhang, the cup extending into the container connector and including at least one opening at the bottom having such small dimensions that, when the pressure above and below this opening is the same, the liquid substance in this cup is prevented by its capillarity from flowing through the opening into the container and, when the twist cap is loosened, thereby carrying the connector sleeve along with it and unscrewing it from the connector, the pressure between the container interior and the ambient air equalizes and, due to the higher pressure in the twist cap, the liquid substance is pressed out of the cup through this at least one opening and into the container.

Two embodiments of this closure device are described and their function is explained in the following, with reference to the drawings.

Figure 1:
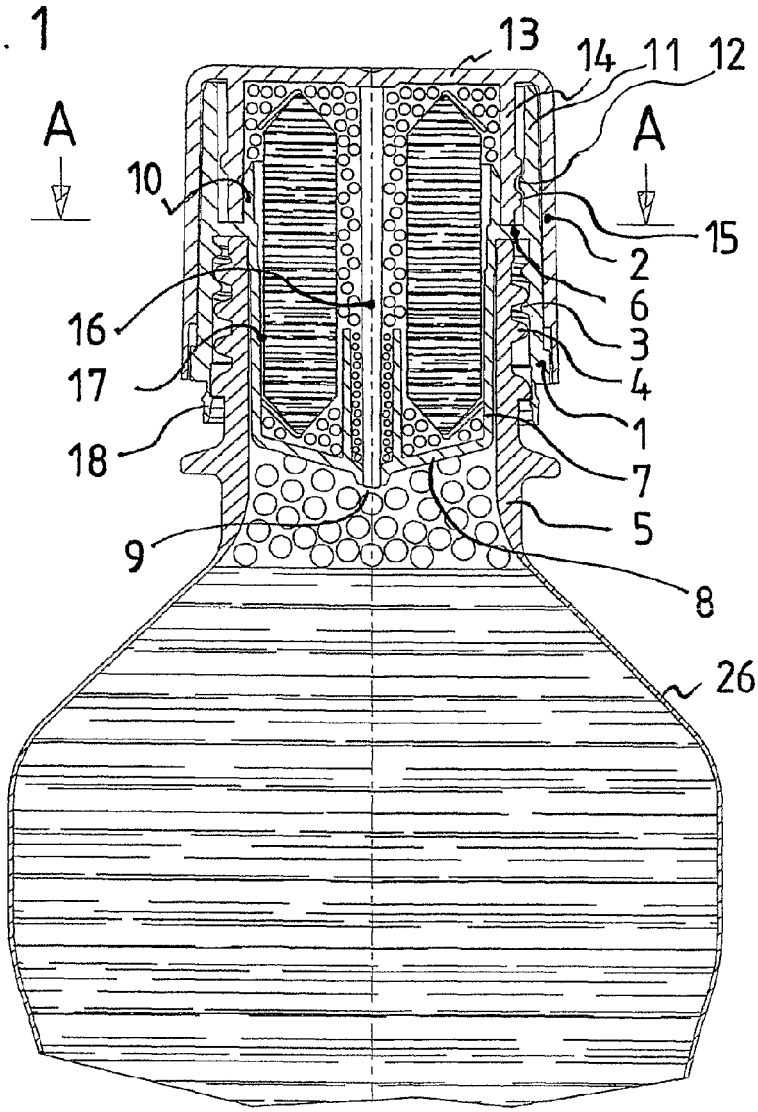
Figure 2:
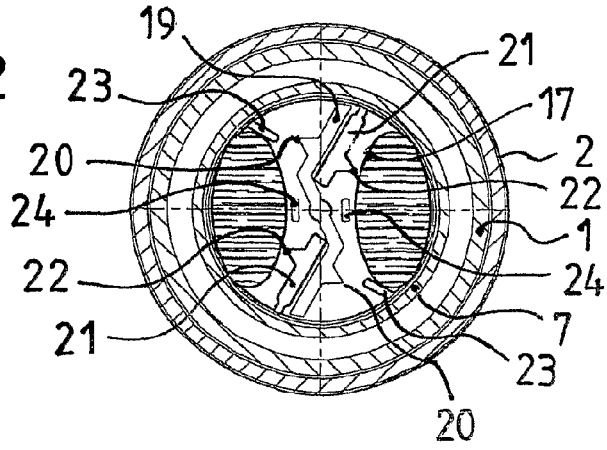
Figure 4:
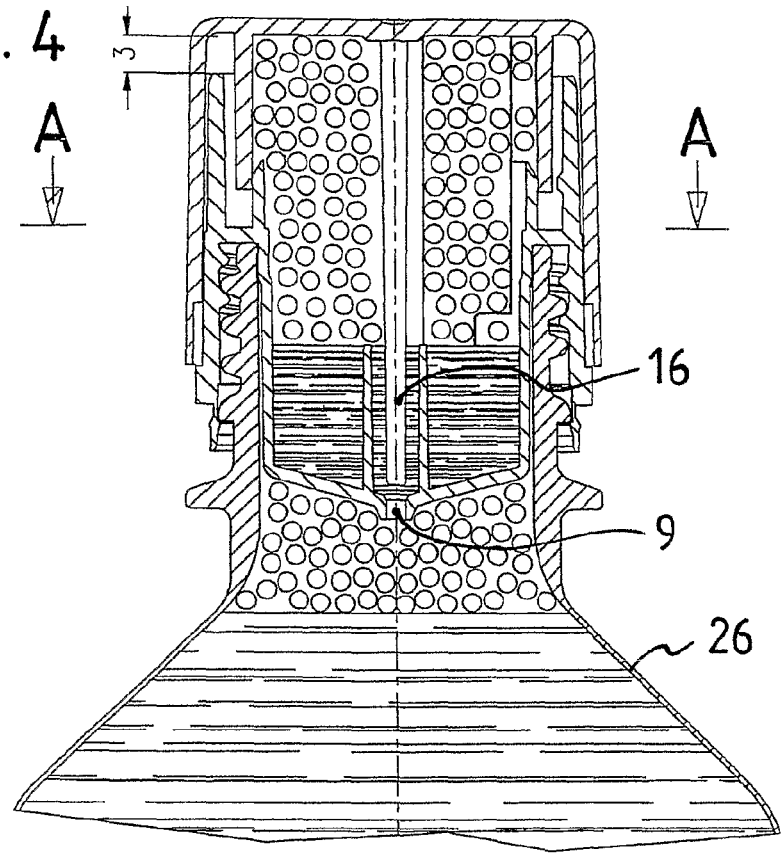
Figure 3:
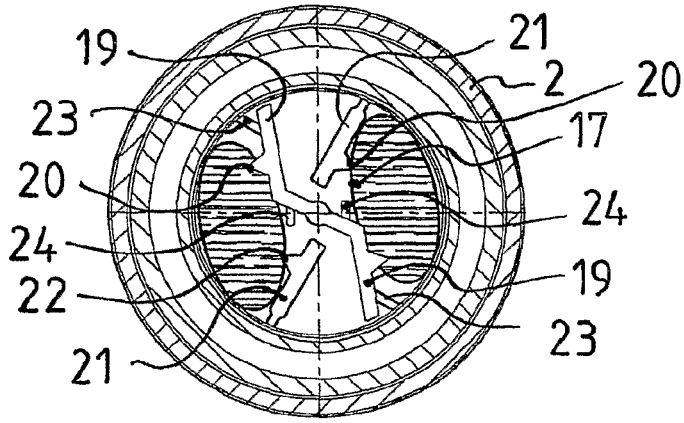
Figure 5:
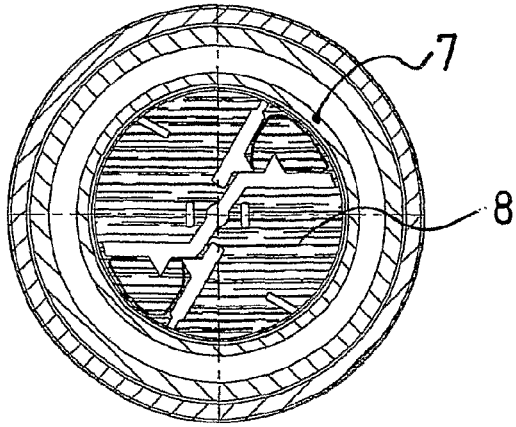
Figure 6:
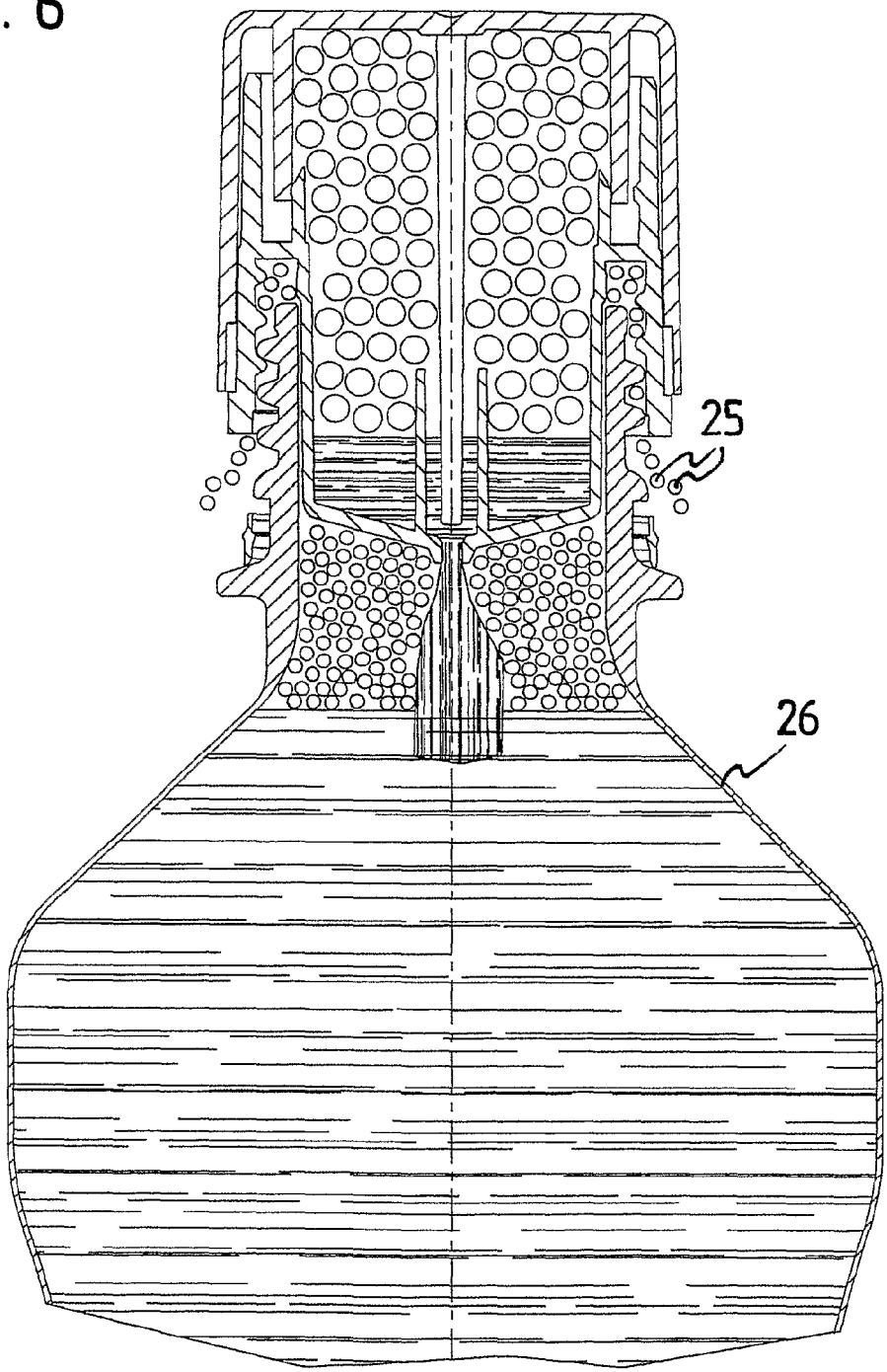

They show:

FIG. 1: A longitudinal section through the upper part of a container or a bottle and the first variant of the closure device with which it is equipped, in the initial closed position of the closure device;

FIG. 2: A top view of the cross section of the closure device along plane A-A in FIG. 1;

FIG. 3: A top view of the cross section of this closure device along plane A-A in FIG. 1 after an initial rotation of the twist cap, with the resultant squeezing of the substance capsules;

FIG. 4: A longitudinal section through the upper part of a bottle and this closure device with which it is equipped, after the initial rotation of the twist cap relative to the connector sleeve;

FIG. 5: A top view of the cross section of this closure device along plane A-A in FIG. 1 after a further rotation of the twist cap, with the resultant opening of the substance capsules;

FIG. 6: A longitudinal section through the upper part of a bottle and this closure device with which it is equipped, during the loosening of the twist cap and carrying along the connector sleeve.

Figure 7:
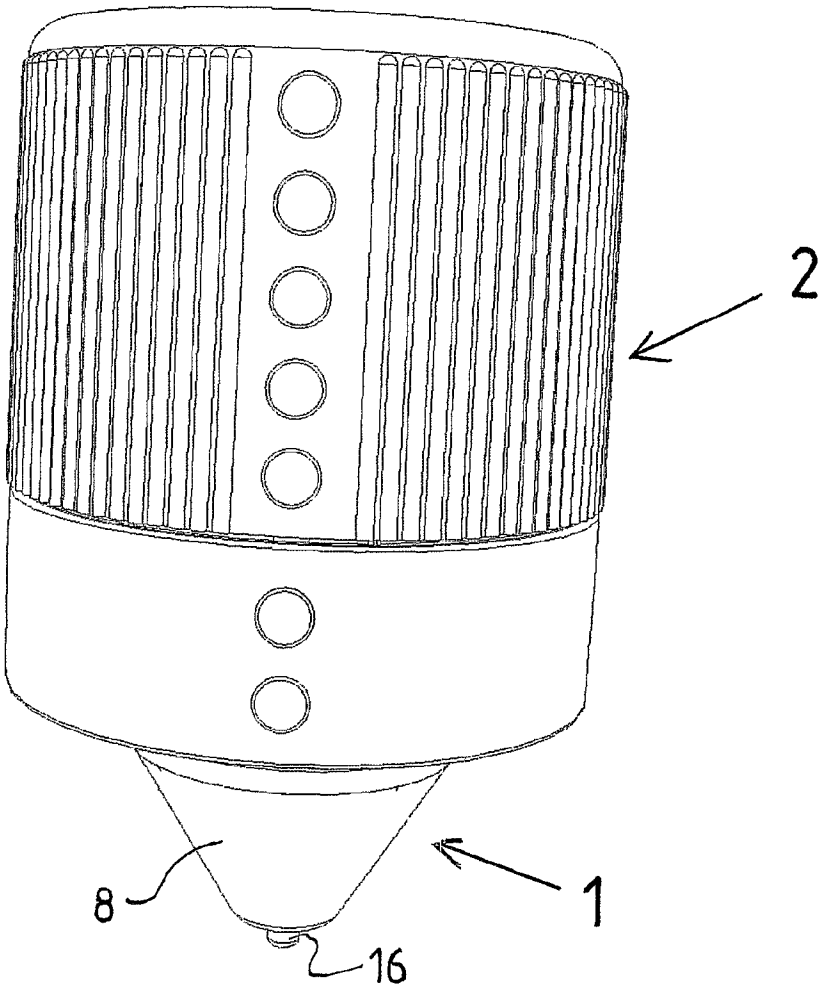
Figure 8:
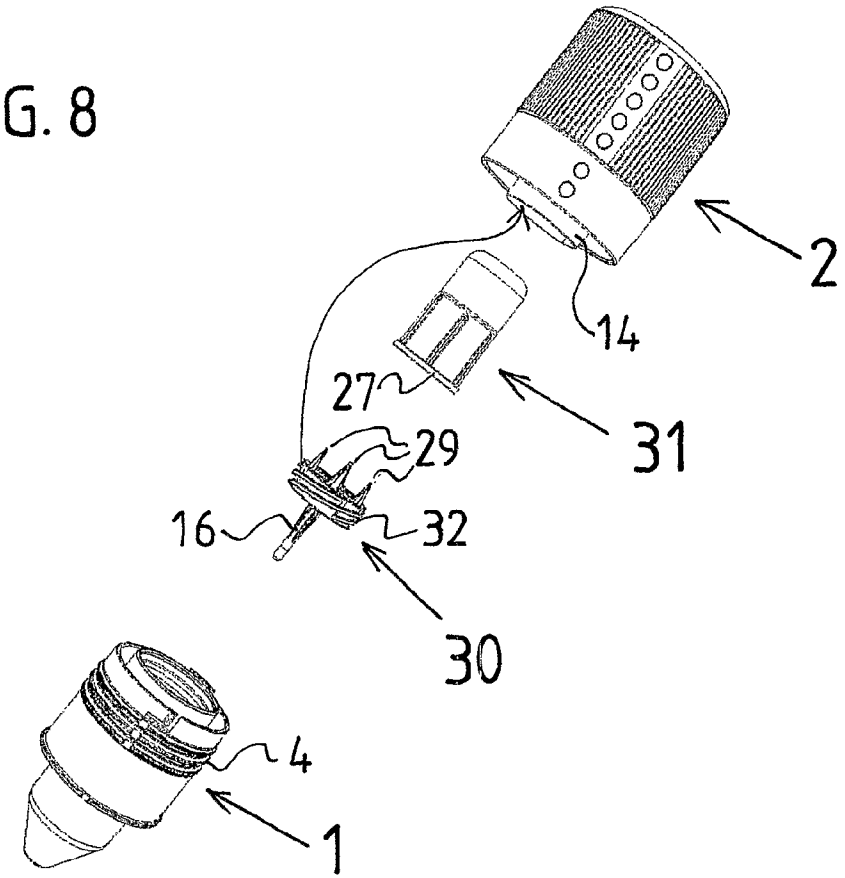
Figure 9:
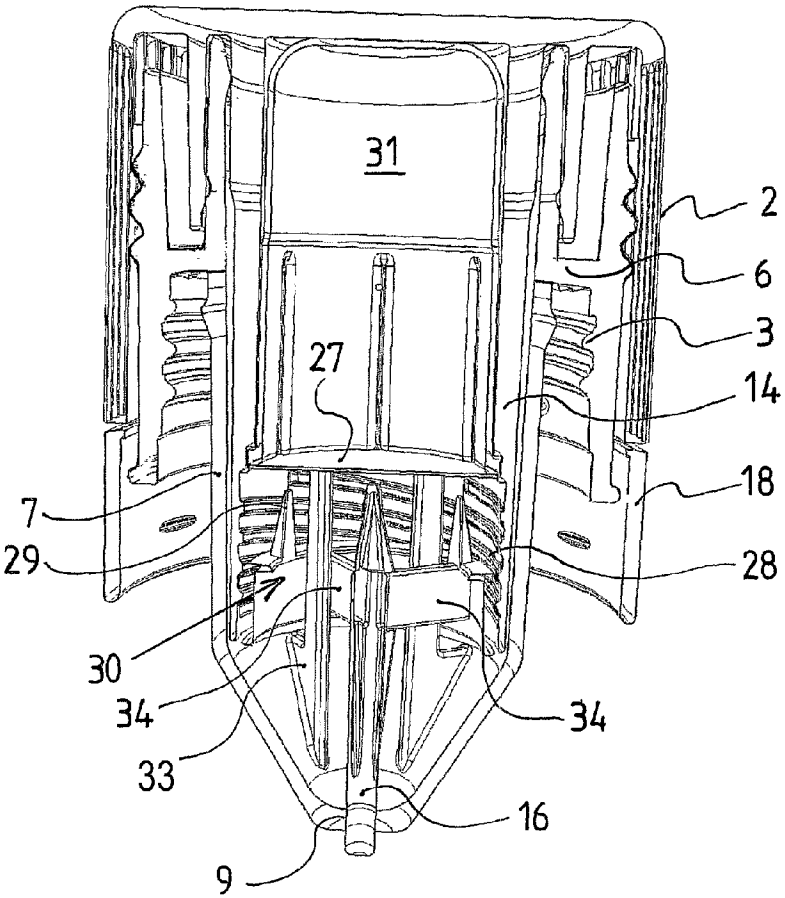
Figure 10:
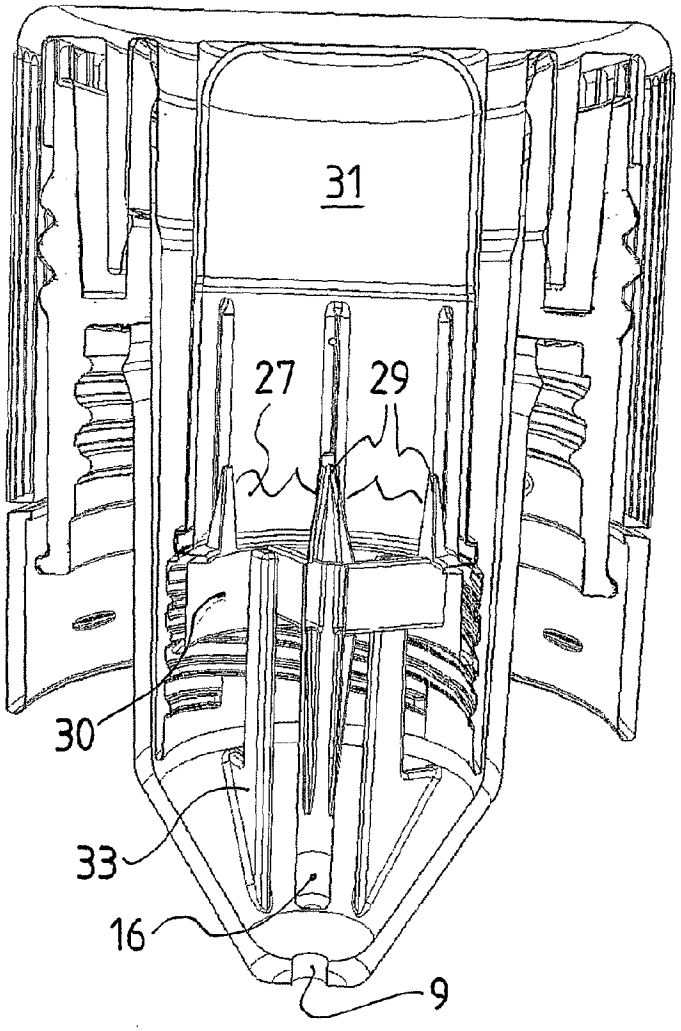
Figure 11:
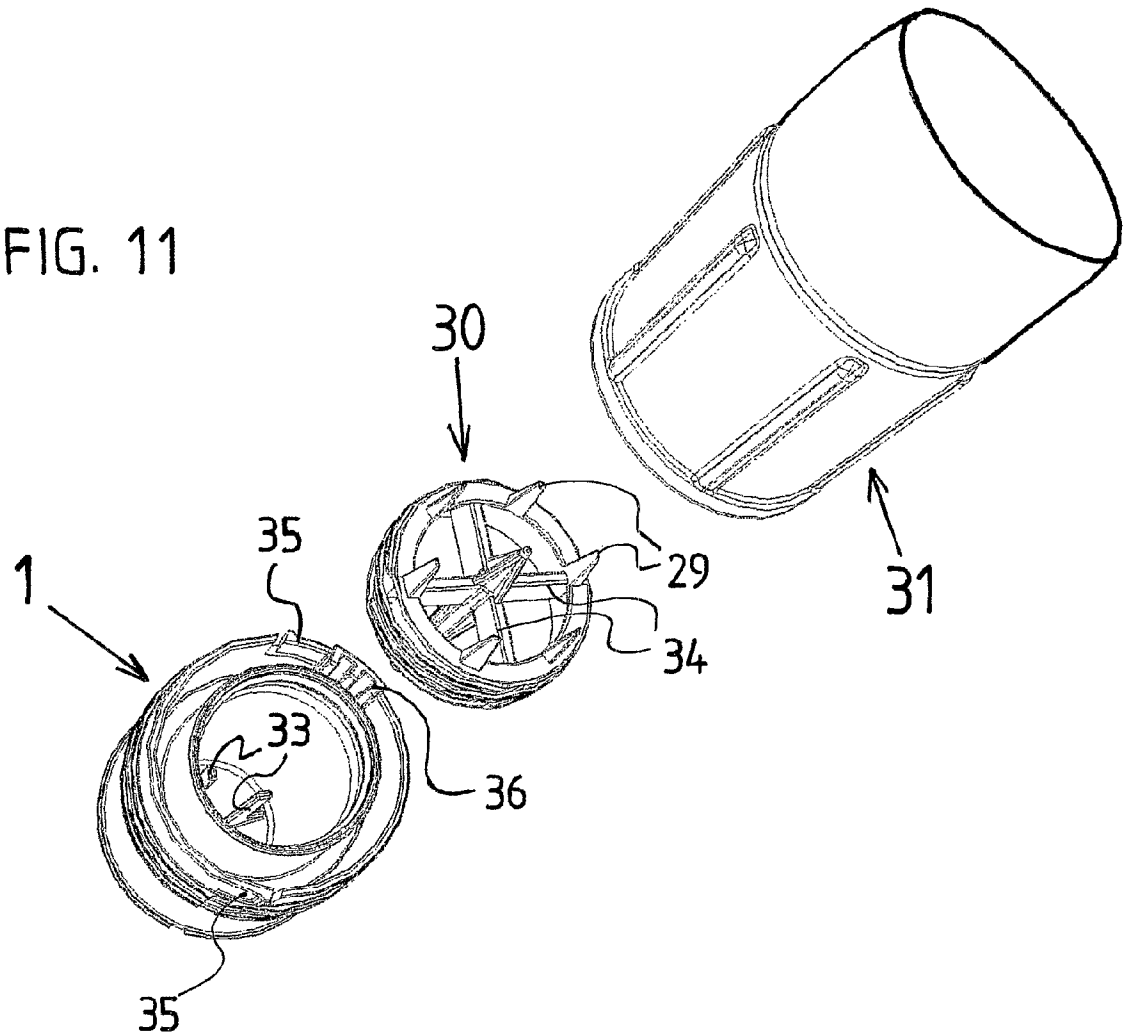

FIG. 7: A second variant of the closure device, in the initial closed position of the closure device;

FIG. 8: This second variant of the closure device, disassembled into its four individual parts;

FIG. 9: This second variant in a longitudinal section through the assembled closure device, in the initial closed position;

FIG. 10: This second variant in a longitudinal section after the cup filled with the separate substance has been opened;

FIG. 11: The connector sleeve, the piercing and cutting ring, and the substance cup of this second closure device variant as viewed obliquely from above;

FIG. 1 shows a longitudinal section through the upper part of a bottle, as the container, and the closure device, in the initial state of the closed closure device. The closure device is composed mainly of two parts, namely a connector sleeve 1 and a twist cap 2 that can be placed thereon. Connector sleeve 1 is screwed via its internal thread 3 onto external thread 4 of bottle connector or container connector 5. Connector sleeve 1 forms, via its outer side, a connector for a twist cap 2 that can be placed thereon with an exact fit. In the example shown, the outer side of connector sleeve 1 is smooth, and the associated inner side of twist cap 2 is also smooth, thereby ensuring a true flush fit. A tamper-proof strip 18 is integrally formed on the lower edge of connector sleeve 1, and wraps around an overhang on bottle connector or container connector 5 and reaches behind it slightly, thereby ensuring that connector sleeve 1 can be unscrewed only after tamper-proof strip 18 has been torn away from its lower edge or connector sleeve 1 has been rotated with so much force that tamper-proof strip 18 tears. Connector sleeve 1 contains, approximately halfway up its height, an inwardly extending overhang 6; starting from inner edge of overhang 6 and extending downward, a cup 7 is formed that fits via its outer wall into the interior of bottle connector 5. Base 8 of cup 7 is slanted downward toward its center and includes a hole in the center in the form of an opening 9 or a slit, thereby resulting in a type of funnel. It is essential that cup base 8 slant downward everywhere toward the opening, regardless of where the hole or opening 9 is located. Above overhang 6 and starting at its upper, inner edge, an upwardly extending collar 10 is integrally formed thereon, thereby forming the upper edge region of cup 7. An internal thread 12 is formed on the inner side of connector 11 which is formed by connector sleeve 1 and extends upwardly. Associated twist cap 2 fits onto connector sleeve 1. A nipple 14 having an external thread 15 is integrally formed on the underside of cap cover 13, and interacts with internal thread 12 on connector 11. Furthermore, an arbor 16 is integrally formed on the underside of cap cover 13, which seals shut opening 9 in the base of cup 7 in the starting position shown here. To this end, arbor 16 can taper slightly conically at the end so that it achieves a good sealing effect in opening 9. External thread 15 and associated internal thread 12 are designed such that twist cap 1 on the connector of connector sleeve 1 can be rotated or unscrewed only across a certain range, after which twist cap 2, if loosened further, carries along connector sleeve 1 and causes it to rotate, thereby unscrewing connector sleeve 1 from the thread of bottle connector 5.

A liquid substance is contained inside the closure device, that is, in inner cup 7 of connector sleeve 1. The liquid substance can be filled directly into cup 7, or it can be accommodated in separate substance containers inserted into the cup e.g. in capsules 17, for example, as shown here. The small circles indicate gasses or air, while all regions that are filled with horizontal lines each represent a liquid. FIG. 2 shows a top view of the cross section of the closure device along plane A-A in FIG. 1. Proceeding from the outside toward the inside, the figure shows twist cap 2, then connector sleeve 1, and, finally, cup 7 on connector sleeve 1. Two capsules 17 are shown in the interior of cup 7, each of which contains the liquid substance to be added in a metered manner. Vanes 19 are integrally formed on either side of central arbor 16, and are also integrally formed at the top on the cap cover of cover cap 2, and include an edge 20 for piercing and cutting on their respective sides that point in the counterclockwise direction, as viewed from above. Ribs 21 are integrally formed on the inner wall of cup 7, each of which includes a piercing and cutting edge 22 on their surfaces that point in the clockwise direction as viewed from above. In addition, two retaining strips 23 are integrally formed on the inside of cup 7. Two clamping rods 24 are integrally formed on cup base 8, close to opening 9. Capsules 17 are blister packages of fluids or tubular bags filled with a liquid substance, which are manufactured and filled in a known manner. Capsules 17 can be designed to be impermeable to oxygen and water vapor e.g. by forming them of a laminate that contains an aluminum layer. Capsules 17 are inserted into cup 7 from above and are then placed between retaining strips 23 and the inner edge of cup 7, where they are held by clamping rods 24 that are bent elastically toward the center of cup 7 when capsules 17 are inserted and press capsules 17 toward the inner wall of the cup due to their restoring force.

FIG. 3 shows a top view of this cross section of closure device along plane A-A in FIG. 1, which occurs after an initial rotation of twist cap 2 and the resultant squeezing of substance capsules 17. When twist cap 2 is rotated in the loosening direction as viewed from above, that is, in the counterclockwise direction, vanes 19 located thereon also rotate. Since vanes 19 are integrally formed at the top on cap cover 13, a torque is transmitted to them by twist cap 2, thereby enabling them to initially clamp capsules 17 between ribs 21 and themselves, and to then pierce capsules 17 using their piercing edge 20, and so capsules 17 burst and their contents flow downward.

FIG. 4 shows another longitudinal section through the upper part of a bottle and the closure device which is now filled directly with a liquid substance. The closure device is shown in the instant after arbor 16 was withdrawn from opening 9 via an initial rotation of twist cap 2 relative to connector sleeve 1. Internal thread 12 on the inside of upper connector sleeve section interacts with external thread 15 on the outside of nipple 14 on cover 13 of twist cap 2, and so, upon the initial rotation relative to connector sleeve 1, twist cap 2 is initially rotated relative to connector sleeve 1 and is moved upward relative to connector sleeve 1. As a result, arbor 16 on cover 13 is withdrawn from opening 9 in cup 7, thereby exposing opening 9 that it had previously sealed shut. At the same time, capsules 17 that contain the separate fluid substance as shown in FIGS. 1 through 3 are pierced or cut open since an upward motion is superposed on the rotation of twist cap 2, and so piercing edges 20 on vanes 19 apply pressure and are moved in the axial direction of the closure device, thereby creating a cutting effect. If the fluid is filled directly in closure device cup 7, a separate opening of capsules 17 is not required. In either case, the following now happens as soon as arbor 16 exposes opening 9, or if opening 9 is open from the start if an arbor 16 is not present: If the closure device is screwed onto a bottle having contents that are carbonated, the pressure inside the bottle exceeds the pressure outside the bottle shortly after the closure device is screwed on, due to gas release that occurs. A period of at least a few hours, if not a few days or weeks, pass between the time when the bottle is filled and when it is opened for the first time. The gas release occurs during this period, until a vapor pressure equilibrium is reached. If the closure device is now opened, that is, if arbor 18 is withdrawn from opening 9, or if opening 9 is already open because an arbor is not provided, gas flows immediately out of the space above the level of the liquid in the bottle, upward through opening 9 and into the upper part of closure device. Gas flows through opening 9 into the closure device and, therefore, into the space above the liquid substance contained therein until pressure balance is reached. This pressure balance occurs within a fraction of a second the first time the twist cap is rotated after the closure device is opened. If an arbor is not present, the pressure compensation occurs as soon as the bottle is closed using the closure device. During this pressure compensation, fluid cannot flow downward through opening 9 and, in fact, in neither case, namely when the fluid lies directly in cup 7 and when capsules 17 are located in the cup, which are pierced when the twist cap is initially rotated, and their contents run out and collect in cup 7. The reasons for this are that, when gas flows through opening 9 from the bottom to the top, fluid cannot simultaneously flow downward through opening 9, and that opening 9 is dimensioned such that opening 9 holds the fluid back due to the capillarity of the liquid substance since air cannot enter from the outside above the liquid due to the seal between connector sleeve 1 and twist cap 2. The situation shown in FIG. 4 therefore occurs in both cases, that is, when the liquid substance is first packaged in separate capsules 17 and when it is filled directly in cup 7 in the closure device. In this case, arbor 16 is withdrawn from opening 9, the liquid is located at the bottom of the cup, but it remains in the cup, and does not yet flow through small opening 9.

After the initial rotation of the twist cap, which has since taken place, the situation depicted in FIG. 5 occurs, in which a top view of the cross section of the closure device along plane A-A in FIG. 1 is shown. The fluid fills the entire cross section of cup 7 and lies on cup base 8.

If, proceeding from the situation depicted in FIG. 4 or 5, twist cap 2 is rotated further in the loosening direction, it carries along connector sleeve 1 disposed thereon. Twist cap 2, including connector sleeve 1, then rotate, and connector sleeve 1 is then unscrewed from bottle connector or container connector 5. After a brief rotation, the seal between the closure device, that is, between connector sleeve 1 and bottle connector or container connector 5, is broken. The overpressure present in the bottle or container 26 relative to the atmosphere is relieved immediately by gas escaping from the bottle into the atmosphere. This is indicated in FIG. 6 using escaping gas bubbles 25. This initial escape of gas also occurs with all previous closure devices for bottles of this type for carbonated beverages. Upon every initial opening, this escape is accompanied by an escape of a small amount of gas from the bottle, accompanied by a "pfffffffff" sound. Since the pressure inside the bottle has now abruptly dropped to atmospheric pressure, a simultaneous pressure difference occurs between the bottle contents and the cup contents in the closure device. The same pressure initially exists in the cup that was present in the bottle at the beginning. As a result, the fluid contained in the cup is now injected through opening 9 with a powerful injection surge into the bottle, and, in fact, is practically shot through opening 9, by this overpressure in the cup instantaneously, that is, even while the closure device or connector sleeve 1 is being unscrewed from bottle connector or container connector 5. This brief injection surge takes place as the distinct "pfffffffff" sound occurs while the closure device is being unscrewed, and creates a spectacular visual display.

FIG. 7 shows a second variant of a closure device of this type, which is composed of a total of four pieces, only two of which are visible here, namely base 8, which tapers downward conically, of connector sleeve 1, and twist cap 2 which is rotatably pressed onto connector sleeve 1. Arbor 16 that extends out of opening 9 is shown at the very bottom. FIG. 8 shows all four pieces of this closure device variant in an exploded view, aligned on the common axis of rotation. Connector sleeve 1 is shown at the bottom. After the closure device is installed, connector sleeve 1 is screwed into place over the external thread of the connector of a container or a bottle, for the purpose of which it includes an internal thread that is not visible here. On its outer side, connector sleeve 1 is equipped with ridges 4 in the upper part, onto which corresponding ridges of associated twist cap 2 fit, thereby enabling twist cap 2 to be pressed onto connector sleeve 1 and rotated thereupon across a certain range. These ridges are not a thread! A piercing and cutting mechanism 30 is shown above connector sleeve 1. It forms a type of spoke wheel having an external thread 32 on the outside of the wheel, that is, on the wheel running side. External thread 32 matches an internal thread on nipple 14 in the interior of twist cap 2, as indicated by the arrow. Cutting tips 29, which direct upwardly, are integrally formed on piercing and cutting mechanism 30, and are used to open the film on the substance cup, as will be explained below. The substance container, which is designed as a substance cup 31 in this case, is shown above cutting tips 29. It is shown upside down, and it is sealed shut at the bottom with a foil 27. Substance cup 31 can be manufactured of an oxygen-tight material and then closed using a foil 27 having a similar thickness, thereby making aseptic filling possible. Twist cap 2 is shown at the top, which includes a nipple 14 in the interior, which is integrally formed on the underside of the cover of twist cap 2. Nipple 14 is used to receive substance capsule 31. FIG. 9 illustrates how these four elements of this second variant of the closure device interact.

To this end, FIG. 9 shows a longitudinal section through the entire closure device, in its initial closed position after installation. Twist cap 2 is pressed onto one of the connector sleeves 1 via its ridges. Twist cap 2 includes a nipple 14 on the underside of its cover, which is equipped with an internal thread 28 on the lower end. Substance cup 31 is inserted in the upper region of nipple 14, in the upside-down position, with foil 27 pointing downward. A tamper-proof strip 18 is integrally formed at the bottom, on the outermost gripping edge of twist cap 2. Tamper-proof strip 18 must be torn away before the closure device on a container equipped therewith can be opened. Twist cap 2 is seated on connector sleeve 1 via a slotted connection, thereby ensuring that it can be rotated relative to connector sleeve 1. Above an inner overhang 6, connector sleeve 1 carries a cup 7 that is open toward the top, and that tapers downwardly toward an outflow opening 9. Nipple 14 fits exactly in cup 7. Internal thread 3 is shown in the lower region of the outer part of connector sleeve 1, using which connector sleeve 1 can be screwed onto a container connector having an external thread. Piercing and cutting mechanism 30 is held via its own external thread on internal thread 28 in the lower part of nipple 14. Piercing and cutting mechanism 30 is designed as a spoke wheel and includes upwardly directed cutting tips 29. Upwardly extending retaining rods 33 are integrally formed on conically tapering base of cup 7, which penetrate spokes 34 of piercing and cutting mechanism 30. Piercing and cutting mechanism 30 is also provided with an arbor 16 that extends downward in the center and is inserted through opening 9, thereby sealing it shut.

The function of piercing and cutting mechanism 30 is explained with reference to FIG. 10. The threaded connection to nipple 14 must be designed such that, when nipple 14 is rotated via the rotation of twist cap 2, piercing and cutting mechanism 30 is moved axially upward because it is prevented by stationary retaining rod 33 from carrying along nipple 14. If piercing and cutting mechanism 30 is displaced upwardly, however, its cutting tips 29 pierce foil 27 of substance cup 31 and cut it open, as shown in the figure, and so the liquid substance in substance cup 31 flows downward and collects in the cup base above opening 9. The upward motion of piercing and cutting mechanism 30 also causes arbor 16 to be withdrawn from opening 9 which is now exposed. The liquid substance does not necessarily flow out, however. Opening 9 can be designed so small that the capillarity of the liquid substance initially prevents it from flowing through the opening, and it flows only when an adequate pressure differential exists between the liquid substance and the interior of the container underneath opening 9.

FIG. 11 shows connector sleeve 1, piercing and cutting mechanism 30, and substance cup 31 at an oblique angle from above. Spokes 34 on piercing and cutting mechanism 30 are clearly shown. Retaining rods 33 on the base of cup 7 in the interior of connector sleeve 1 extend, in the installed position, between spokes 34 of piercing and cutting mechanism 30 and beyond them in an upward direction, thereby securing its rotational position in nipple 14. Cutting tips 29 on piercing and cutting mechanism 30 are also shown. Two catches 35 are integrally formed at the top on the edge of connector sleeve 1, and so is a stop element 36. When twist cap 2 is screwed onto connector sleeve 1, these elements ensure, via their counterpieces in the interior of twist cap 2, that the following takes place when the closure device is opened, that is, when twist cap 2 is initially rotated in the counterclockwise direction, as viewed from above: In a first phase, twist cap 2 is rotated horizontally relative to connector sleeve 1, while catch 35 makes a latching sound. As a result of this rotation, piercing and cutting mechanism 30 is retained in its rotational position in the interior of nipple 14, which is now rotating. Piercing and cutting mechanism 30 is now moved upward due to its threaded connection to nipple 14, as shown most clearly in FIGS. 9 and 10. Cutting tips 29 of piercing and cutting mechanism 30 pierce foil 27 of substance cup 31 in the interior of nipple 14. At the same time, arbor 16 on piercing and cutting mechanism 30, if one is present, is withdrawn upward out of opening 9. When these movements have been completed, twist cap 2 on connector sleeve 1 hits a stop. The rotational motion is limited by stop element 36. Only now does pressure compensation occur between the container interior underneath opening 9 and the interior of cup 7 and substance cup 31, and the fluid from substance cup 31 collects on the base of cup 7. The fluid is under high pressure relative to the atmosphere when the container on which the closure device is seated is filled with a gas releasing fluid such as mineral water which has been carbonated. If twist cap 2 is now rotated further in the loosening direction, it carries along connector sleeve 1. If this is rotated in the loosening direction, however, it is unscrewed from the container connector, which ultimately causes pressure in the container to drop to the level of the ambient pressure i.e. atmospheric pressure. A pressure difference between the interior of the cup and the interior of the container therefore sets in abruptly, even before the closure device has been completely unscrewed from the container connector. As a result of this pressure difference, the liquid substance located above opening 9 is pressed powerfully by the higher pressure present in cup 7 through opening 9 into the interior of the container, producing a distinct, shrill "pfffffffff" sound. This injection can be observed when the container is made of transparent material such as glass or PET, and the injection creates a visually impressive display.

The invention claimed is:

1. A closure device for a metered addition of a liquid substance packaged separately in the closure device into a container (26) equipped therewith and containing a gas releasing liquid, the closure device comprising a connector sleeve (1) and a twist cap (2) fitting thereon from above in an air-tight manner, wherein the liquid substance is enclosed between the connector sleeve (1) and the twist cap (2), the connector sleeve (1) holds a cup (7) via an inner overhang (6), the cup (7) extending into a connector (5) of the container (26) and including at least one opening (9) at a bottom thereof, the opening (9) having such a small dimension that when a pressure above and below the opening (9) is the same, the liquid substance in the cup (7) is prevented by capillarity from flowing through the opening (9) into the container (26), and wherein the liquid substance is stored in a separate, foil-sealed substance cup (31) which is inserted upside-down in a nipple (14) integrally formed on an inside of the twist cap (2), with a foil (27) pointing downward, wherein the nipple (14) extends downwardly past the substance cup (31) and has an internal thread (28) on which a piercing and cutting mechanism (30) having upwardly directed cutting tips (29) is rotatably supported; the cup (7) tapering downward conically toward the opening (9) and, in an interior of a conically tapering base of the cup (7), upwardly extending retaining rods (33) are integrally formed and the retaining rods (33) penetrate the piercing and cutting mechanism (30) and secure the piercing and cutting mechanism (30) from rotating relative to the cup (7), so that when the twist cap (2) and the nipple (14) integrally formed thereon are rotated in a loosening direction, the piercing and cutting mechanism (30) is moved upward by a threaded connection and without rotating, to open the foil (27) using the cutting tips (29), and wherein when the twist cap (2) is further loosened, thereby carrying along the connector sleeve (1), a pressure of an interior of the container (26) and a pressure of the ambient air equalize and, due to a higher pressure in the cup (7) the liquid substance is pressed out of the cup (7) through the opening (9) into the container (26).

2. The closure device according to claim 1, wherein a stop (36) is provided between the twist cap (2) and the connector sleeve (1), thereby enabling the twist cap (2) to be rotated along a limited path relative to the connector sleeve (1).

3. The closure device according to claim 1, wherein the piercing and cutting mechanism (30) includes an arbor (16) extending downward, when the twist cap (2) is in a closed position, the at least one opening (9) is closed in a sealed manner by the arbor (16), and when the twist cap (2) is rotated in the loosening direction, the piercing and cutting mechanism (30) is moved upward, withdrawing the arbor (16) upward out of the opening (9) and exposing the opening (9).

4. The closure device according to claim 1, wherein the substance cup (31) is filled separately aseptically with the liquid substance and is then sealed shut aseptically using the foil.

5. The closure device according to claim 1, wherein the opening (9) in the bottom of the cup (7) has such a small dimension that the liquid substance in the cup (7) is prevented by capillarity from flowing downward through the opening (9) due to gravity alone, and flows only under a force of an induced pressure difference between an interior of the cup and an interior of the container.

6. The closure device according to claim 2, wherein when the twist cap (2) is rotated in the loosening direction until hitting the stop (36), the piercing and cutting mechanism (30) is moved upward, causing piercing of the foil (27) of the substance cup (31) and releasing the liquid substance into the cup (7), and causing withdrawing the arbor (16) upward out of the opening (9), thereby a pressure compensation occurs between an interior of the container (26) underneath the opening (9) and an interior of the cup (7) and the substance cup (31), and when the container (26) is filled with the gas releasing liquid, the liquid substance in the cup (7) is under a pressure higher than the pressure of the ambient air.

7. The closure device according to claim 6, wherein when the twist cap (2) is further rotated in the loosening direction, carrying along the connector sleeve (1), the pressure in the container (26) drops to a level of the pressure of the ambient air as the connector sleeve (1) is to be unscrewed from the connector (5) of the container (26), thereby causing the liquid substance in the cup (7) to be injected through the opening (9) into the container (26).

8. The closure device according to claim 2, wherein the stop (36) is integrally formed at an edge of a top side of the connector sleeve (1).

9. The closure device according to claim 1, wherein the connector sleeve (1) further comprises two catches (35) integrally formed at an edge of a top side of the connector sleeve (1).

10. The closure device according to claim 1, wherein the connector sleeve (1) further comprises ridges (4) at an upper part of an exterior thereof, enabling the twist cap (2) to be pressed onto the connector sleeve (1) and rotated on the ridges (4) across a certain range.

11. The closure device according to claim 1, wherein the piercing and cutting mechanism (30) comprises a spoke wheel with the cutting tips (29) extending upwardly thereon.

12. The closure device according to claim 11, wherein the retaining rods (33) inside the base of the cup (7) penetrate through spokes (34) of the spoke wheel of the piercing and cutting mechanism (30).

13. The closure device according to claim 11, wherein an arbor (16) extends downward at a center of the spoke wheel, and is axially aligned with the opening (9) at the bottom of the cup (7).

14. The closure device according to claim 11, wherein the spoke wheel has an external thread (32) on an outside thereof, matching the internal thread (28) on the nipple (14).

15. The closure device according to claim 1, wherein the nipple (14) extends downward from a top of the twist cap (2) and fits inside of the cup (7).

16. The closure device according to claim 1, wherein the closure device further comprises a tamper-proof strip (18) integrally formed at a bottom of and on an outermost gripping edge of the twist cap (2).

* * * * *